US005558428A

United States Patent [19]

Lehrer et al.

[11] Patent Number: 5,558,428

[45] Date of Patent: Sep. 24, 1996

[54] PORTABLE READING LIGHT DEVICE

[76] Inventors: Robert A. Lehrer, 7413 McCool Ave., Los Angeles, Calif. 90045-1233; Kenneth A. Tarlow, 94 Birch Ave., Corte Madera, Calif. 94925

[21] Appl. No.: 301,670

[22] Filed: Sep. 7, 1994

[51] Int. Cl.[6] ..... F21L 15/14

[52] U.S. Cl. ..... 362/105; 362/186

[58] Field of Search ..... 362/105, 106, 362/157, 186, 326

[56] References Cited

U.S. PATENT DOCUMENTS

| | | | |
|---|---|---|---|
| 1,187,672 | 6/1916 | Stiefvater | 362/105 |
| 1,392,165 | 9/1921 | Hunter | 362/187 |
| 2,117,967 | 5/1938 | Leipold et al. | 762/105 |
| 3,008,040 | 11/1961 | Moore | 362/105 |
| 3,250,909 | 5/1966 | Oldenburger | 362/105 |
| 3,731,084 | 5/1973 | Tavorrow . | |
| 4,462,064 | 7/1984 | Schweitzer . | |
| 4,718,126 | 1/1988 | Slay . | |
| 4,794,496 | 12/1908 | Lanes et al. . | |
| 4,797,793 | 1/1903 | Fields . | |
| 4,916,596 | 4/1990 | Sharrah et al. . | |
| 4,970,631 | 11/1990 | Marshall . | |
| 5,034,862 | 7/1991 | Liston . | |
| 5,115,382 | 5/1992 | Smith | 362/105 |
| 5,117,510 | 6/1992 | Broussard et al. . | |
| 5,325,275 | 6/1994 | Liu | 362/326 |
| 5,440,462 | 8/1995 | Kim et al. | 362/105 |
| 5,503,932 | 10/1991 | Case . | |

*Primary Examiner*—Denise L. Gromada
*Assistant Examiner*—Sara Sachie Raab
*Attorney, Agent, or Firm*—Poms, Smith, Lande & Rose

[57] ABSTRACT

A portable reading light device worn about the head of a user. The light of the device projects a beam for reading a book or magazine or the like and may be adjustable. The light device may be powered by either a DC battery pack or AC. The light diffuses a beam substantially uniformly over a quadrilateral area so that a book or magazine or the like may be read with comfort.

20 Claims, 2 Drawing Sheets

10
11
12
13
14
15
16
17
30,31
36
37
38
39
54
55
60
61
62
63
64
65
66
67
69

PORTABLE READING LIGHT DEVICE

BACKGROUND OF THE INVENTION

1. Field of the Invention

The invention relates to portable reading light devices; and, more particularly, to a light device worn about the head of a user.

2. Description of Prior Art

Various types of reading lights have been proposed in the past. Most of these lights clip on to a book or magazine and illuminate the page by light shining onto the page. Turning pages is a problem since the light device is attached to the pages. A light device useful with a book may not be useful on a newspaper or magazine due to its weight, how it is attached to the reading matter, etc. That is, it is difficult or impossible to read lightweight reading materials, such as paperback books, magazines, newspapers, etc. with certain devices that must be clamped or mounted to a sturdy book or the like to remain in place. These clip-on devices also illuminate a large area surrounding the lit material which may defeat the very purpose of allowing one to read in bed or other places without disturbing those around the reader.

Both types of light devices usually require that the reader be in an upright position and are either uncomfortable or difficult to use when the reader is prone or in a non-sitting position.

Lately, folders or book covers with built-in light devices have appeared in the marketplace. However, newspapers and magazines cannot be inserted into these folders or covers and one size may not fit all books. Further, it is better to have light shining from above or behind the reader and such light devices are not small and portable.

There is thus a need for a light device that can illuminate a page of reading material with the light diffused uniformly on the page and can be worn with ease by the user and permit use with all types of reading materials and allow reading in any desired position.

SUMMARY OF THE INVENTION

It is an object of this invention to provide a reading light device which diffuses a light substantially uniformly on to a page.

It is a further object of this invention to provide a reading light device which is small, portable and can be used with any type of reading material.

It is still further an object of this invention to provide a reading light device that can be used to read a book or the like in a variety of positions of the reader.

It is another object of this invention to provide a reading light device which places a uniform light in a quadrilateral pattern on the page of a book or the like.

These and other objects are preferably accomplished by providing a portable reading light device worn about the head of a user. The light of the device projects a beam for reading a book or magazine or the like and may be adjustable. The light device may be powered by either a DC battery pack or AC. The light diffuses a beam substantially uniformly over a quadrilateral area so that a book or magazine or the like may be read with comfort.

DESCRIPTION OF THE PREFERRED EMBODIMENT

Figure 1:
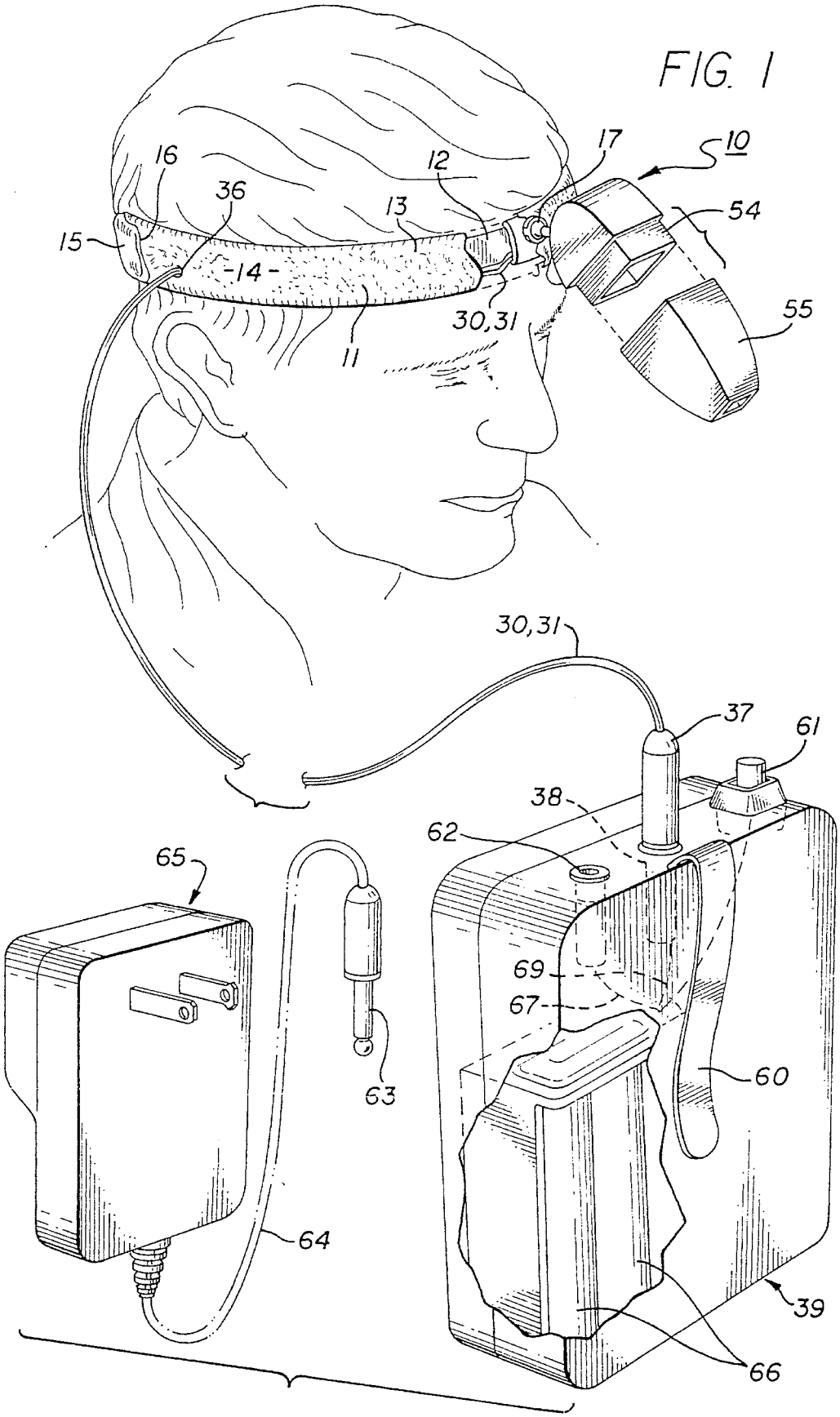
FIG. 1 is an exploded view, partly in section, of a light device, worn by a user in accordance with the teachings of the invention.

Referring now to FIG. 1 of the drawing, device 10 is shown comprising an adjustable headband 11 adapted to be worn about the head of a user. Band 11 is preferably of one elongated unitary piece having securing means, such as Velcro material, associated therewith for quick and easy adjustment and removal. Thus, band 11 may have an internal elongated strip 12 (see also FIG. 2) of nylon or any suitable resilient material. Strip 12 extends inside of a hollow piece 13 of a soft cushioned material, such as velvet. A preferred material is iron velvet known for its wearing abilities. This material has, on its outer surface 14, FIG. 1, closely woven loops of material. One of the terminal ends of band 11, such as end 15, may terminate in a pad 16 of Velcro material, e.g., the hook portion thereof. This pad 16 is sewn or glued or the like on the interior of end 15 and thus is adapted to engage the mating loop material of piece 13 at any desired location to secure band 11 in a quick releasable position about the head of a user.

Obviously, other arrangements may be used but the foregoing describes a lightweight band 11 that is quickly and easily adjustable.

Figure 2:
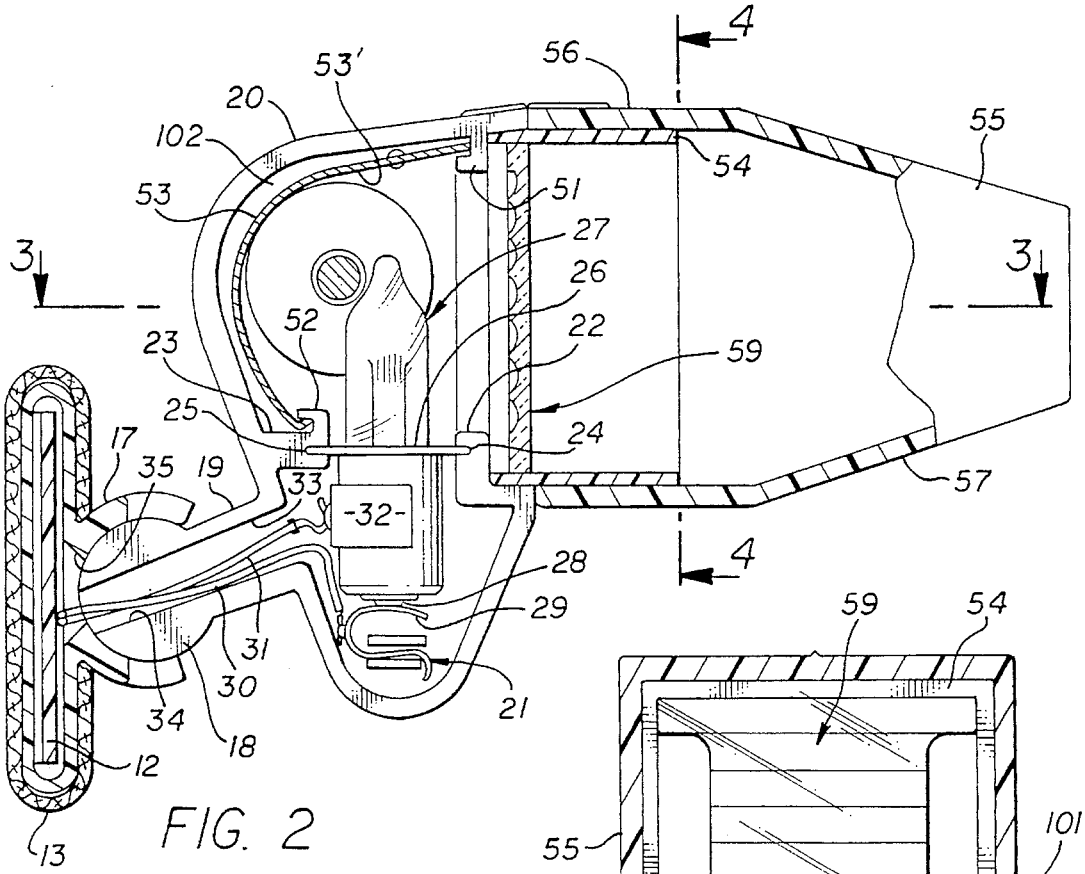
FIG. 2 is an elevational sectional view of the light housing and band of the device of FIG. 1.

As particularly seen in FIG. 2, a socket 17 is secured to strip 12 and opens to the exterior of piece 13 (see also FIG. 1). Socket 17 is adapted to receive a ball 18 (FIG. 2) therein (and is so configured) in a press fit relationship. Ball 18 is integral with a shaft 19 extending from, and also integral with, housing 20.

Housing 20 is thus adjustable with respect to band 11 due to the ball and socket connection. Since ball 18 is press-fit in socket 17, it retains its position therein by friction until manually moved by the user. Thus, housing 20 can be quickly and easily adjusted to focus a beam of light, as will be discussed, for the correct location of the beam of light on a book or the like.

Obviously, any suitable means by making housing 20 adjustable with respect to band 11 may be used.

A conventional spring biased light bulb contact 21 is disposed within housing 20. Housing 20 has a pair of spaced internal flanges 22, 23 with opposed slots therein (slots 24, 25, respectively), receiving therein the peripheral flange 26 of a light bulb 27. The bottom 28 of bulb 27 extends downwardly and contacts the spring 29 of bulb contact 21.

Bulb 27 is preferably a halogen-type bulb and we prefer to use a 5.2 volt, 0.85 amp bulb that snap fits into a C-shaped resilient clip 32. A suitable bulb is Model No. HP250 manufactured by Action Tungs Ram of Hungary.

Electric current is selectively applied to bulb 27 to light the same by wires 30, 31. Wire 30 is coupled to spring 29 and wire 31 is coupled to clip 32 surrounding bulb 27. The shaft 19, ball 18, and socket 17 having aligned throughbores 33 to 35, respectively, receiving wires 30, 31 therethrough. Wires 30, 31 extend about the interior of band 11 and exit out of a remote point, e.g., opening 36 (FIG. 1) and from there extend to a plug 37 receivable in a jack 38 in a portable battery pack 39.

Housing 20 is comprised of two mating parts (FIG. 3), e.g., sections 40, 41, each having an internal cavity, e.g., cavities 42, 43 respectively, with aligned holes 44, 45, respectively. A bolt 46, having a slotted head 47, a shaft 48, and a threaded end 49, extends through aligned holes 44, 45 with nut 50 threaded on end 49. Thus, the two mating parts can be quickly and easily assembled together.

As seen in FIG. 2, a slotted flange 51 is provided on the inner surface of mating sections 40, 41 and a like slotted flange 52 is provided above flange 23. A heat shield 53 is mounted on the interior of the housing 20 secured between flanges 51, 52. Any suitable material may be used, such as a high temperature resistant paper backed with aluminum foil. The foil may be roughened on its shiny side 53' to create a textured surface, this surface or side 53' facing bulb 27. Any suitable materials may be used for housing 20, such as Lexan material, and in any suitable colors, such as black. Lexan is a polycarbonate material manufactured by General Electric and is available in a variety of colors. Of course, other suitable plastics may be used.

For housing 20, it is preferred that the color be opaque. However, a translucent hood 54 may be provided on housing 20 closing off the forward end thereof (see also FIG. 1). Hood 54 may also be made of Lexan material and may be of a contrasting color to housing 20, such as blue. Such color may match the color of band 11 to give the device 10 a pleasing appearance.

Figure 3:
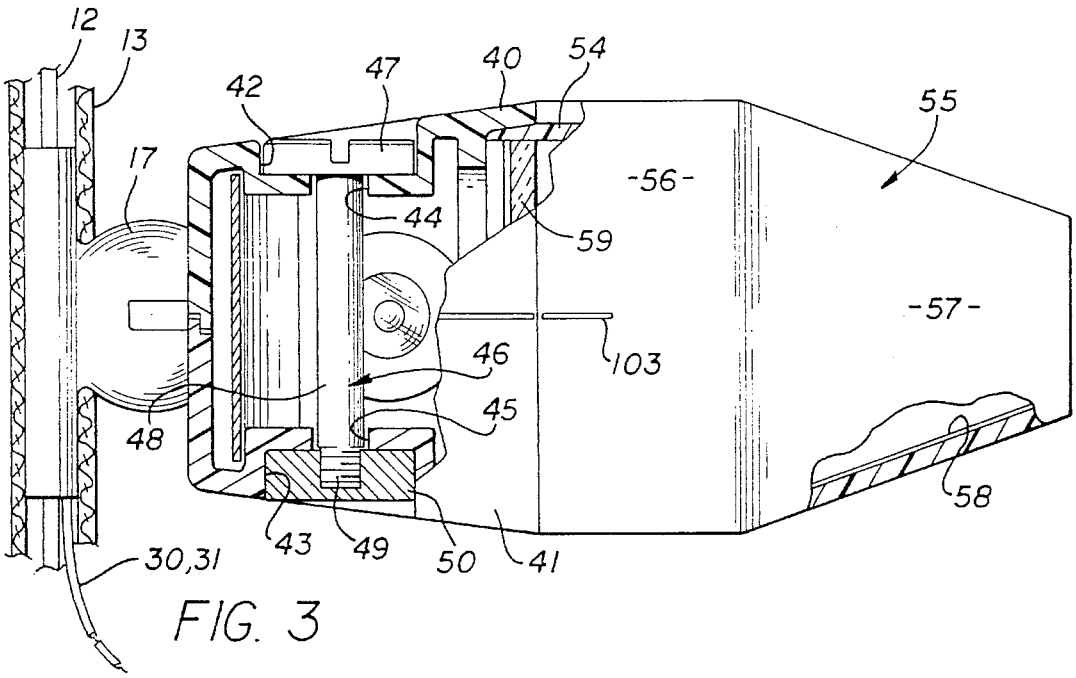
FIG. 3 is a view taken along lines 3—3 of FIG. 2.

A removable lens hood 55 may be provided preferably of the same color and of the same material as housing 20, and merely slides over and onto hood 54 as seen in FIG. 3. Thus, the open interior of device 10 surrounded by fixed hood 54 may be quadrilateral in cross-section, and preferably square-shaped, with removable hood 55 having a first like configured quadrilateral portion 56 and a tapered integral forward portion 57.

As seen in FIG. 3, the interior of the tapered portion 57 of removable hood 55 may be coated white or provided with a white paper coating 58 to assist in improving the light output from bulb 27.

Figure 4:
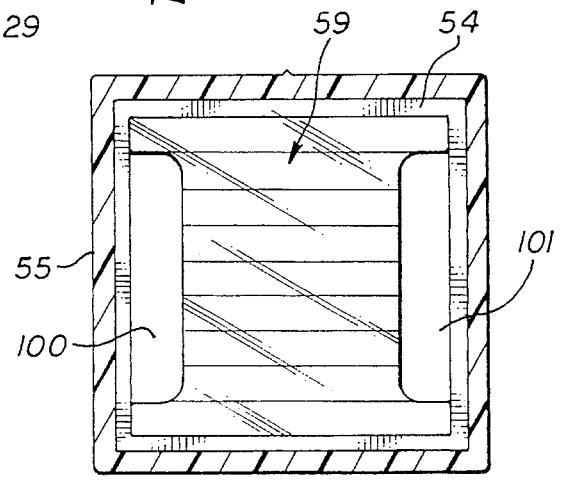
FIG. 4 is a view taken along lines 4—4 of FIG. 2.

A clear lens 59 (FIGS. 2 and 4) is mounted inside of housing 20 at the junction of hood 54 with the remainder of housing 20. Lens 59 may be glued or the like in position and may be ribbed or the like, as seen in FIG. 4, and of a clear Lexan material. Lens 59 thus assists in diffusing the light from bulb 27 so a uniform light is provided. The material of lens 59 may be slightly grainy and, as seen in FIG. 4, may have slots 100, 101 cut-out on each side thereof providing spaces between lens 59 and the interior of housing 20.

A belt clip 60 is provided on the exterior of battery pack 39 for clipping pack 39 to one's belt or the like. An on-off switch 61 is also provided on battery pack 39 to turning light bulb 27 on and off. A second jack 62 may be provided on battery pack 39 for a receiving a plug 63 therein similar to plug 37 coupled via conduit 64 leading to a conventional wall transformer 65, such as a 9 V DC transformer, so that device 10 may be used with either AC or DC current.

Batteries 66 within pack 39 may be removed and replaced and suitable conduits 67 through 69 within pack 39 electronically couple jacks 38, 62, switch 61 and batteries 66 as is well known in the electronics art.

As seen in FIG. 3, indicia, such as a line, on top of housing 20 may be provided to line up with like indicia 103 on top of hood 55 to orient hood 55 to hood 54.

It can be seen that there is disclosed a light device which can be easily worn about the head of a reader and puts out a beam of relatively even white light in a relatively small area. The combination of lens 59, bulb 27 and heat shield 53, which also acts as a light reflector, and the air space 102 (FIG. 2) formed between the inner wall of housing 20 and shield 53, all serve to create a relatively even white light of uniform brilliance. Hood 54, and hood 55, when in place, create a quadrilateral pattern and thus uniformly and evenly light up a page for the reader. The heat resistant paper of shield 53, the air space 102, FIG. 2, and the openings between slots 100, 101 and the inner wall of housing 20 provides for heat dissipation.

The light device can be used with a portable battery pack for DC operation. The battery pack has a receptacle for receiving a plug coupled to an AC converter which plugs into a wall socket for AC operation.

Any suitable dimensions may be used. For example, the conduit between band 11 and plug 37 may be about 60". The conduit 64 between pack 39 and converter 65 may be about 144".

It can be seen that we have disclosed a light device that uses a stylish and adjustable headband.

This allows hands-free operation and the headband is comfortable and functional as it stabilizes the housing for the light source.

The light source is adjustable so that its beam will be pointed in the direction that the user desires.

The light is adjustable so that the beam can be directed at pages of different sizes. It is important that the light clearly illuminates the reading material and not the area surrounding it. This is accomplished by surrounding the light with a quadrilateral shaped lens hood that slides on the housing to make the light beam quadrilateral, not round. The light shines evenly over the reading surface. This is a significant advantage over light sources emitting a "round" light or a circular uneven light. The lighting device is light and small. Any suitable colors or sizes may be used. The interior of housing 20 may be insulated to lower the temperature of the device 10. The on-off button 61 may be color coded to match the color of head band 11. The receptacles 38, 62 on battery pack 39 may be labelled to designate AC or DC inputs. Although the use of Velcro material is suggested in headband 11, any suitable adjustable means, such as a buckle, may be used. Belt clip 60 allows the unit 39 to be worn on one's belt or the like. Pack 39 may have a battery compartment door (not shown) for providing access to batteries 66.

It can be seen that we have disclosed a light weight durable portable bed lamp which can be worn in comfort by a user, can be used in AC or DC operation, emits a bright uniform light and can be used with newspapers, books, magazines, reports, etc.

Although we have described a preferred embodiment of the invention, variations thereof may occur to an artisan and the scope of the invention should only be limited by the scope of the appended claims.

We claim:

1. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a clear light diffusing lens being substantially flat and planar forming a plane having light beam diffusing means thereon for diffusing a beam of light passing therethrough mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb into a light beam emanating through said lens and out of said opening, said bulb being mounted in a bulb socket spaced from said combination between said combination and said lens, said bulb being an elongated halogen bulb extending generally vertically having its longitudinal axis lying in a plane generally parallel to said plane of said lens whereby said combination creates a diffusion of light emitted from said bulb and focuses said light into a light beam passing through said lens while diffusing the same.

2. In the lamp of claim 1 wherein said bulb is a 5.2 volt, 0.85 amp bulb.

3. In the lamp of claim 1 wherein said housing is pivotally connected to said headband by a ball and socket assembly.

4. In the lamp of claim 1 wherein said headband is of velvet material.

5. In the lamp of claim 4 wherein said headband is an elongated strip having hook-type Velcro material at one end thereof adapted to engage loop-type velvet material of said headband.

6. In the lamp of claim 1 wherein said housing is of Lexan material.

7. In the lamp of claim 1 wherein said lens is of Lexan material.

8. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said housing having an interior portion with notch means on the interior portion thereof, said bulb having a peripheral flange thereon snap fitting into said notch means.

9. In the lamp of claim 8 wherein said housing is adjustably connected to said headband by a ball and socket joint, the interior of said headband being hollow, said bulb having an upper end and a bottom and being electronically connected to a power supply by a first electric conduit connected to a C-shaped resilient clip surrounding the upper end of said bulb and by a second electric conduit coupled to a spring engaged by the bottom of said bulb, both of said conduits extending first through a throughbore in said ball and socket joint, then through the interior of said headband and out of an opening therein to said power supply.

10. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a light diffusing lens mounted in said housing spaced from said bulb between said bulb and an opening leading out of said housing disposed away from said bulb, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said lens being ribbed to diffuse light.

11. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said housing having an inner wall surrounding said opening and said lens being attached to the inner wall at the top and bottom thereof with spaced openings on each side of said lens providing communication between said bulb and said opening.

12. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said opening being defined by a quadrilaterally shaped wall, said wall being of an opaque material.

13. In the lamp of claim 12 wherein said housing is of a black plastic material and said wall is of an opaque plastic material lighter than black.

14. In the lamp of claim 12 wherein said wall is square shaped in cross section thereby providing a square-shaped beam of light out of said housing through said opening.

15. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on an particular location in front of the user; and said light housing including a high intensity light bulb mounted therein coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said combination having a first outer reflecting layer of aluminum foil facing said lamp, said foil having a dull surface on one side and a shiny reflecting surface on the other side facing said bulb, and said combination having a second inner layer of a high temperature resistant paper material adhered to said first outer layer.

16. In the lamp of claim 15 wherein said second layer is crinkled.

17. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted thereon coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination of said diffusing lens, said combination being curved in a direction toward said bulb and being adapted to both dissipate heat emitted from said bulb and reflect light emitted from said bulb through said lens and out of said opening;

and a removable hood detachably coupled to said housing, said hood having a throughbore with a first opening leading therein configured similarly to the opening leading out of said housing and telescopingly received thereon, said hood also having a second opening leading from said throughbore out of said hood, said hood being tapered between said first and second openings being widest at said opening on said housing and narrowest at said second opening.

18. In the lamp of claim 17 wherein said hood is of an opaque material and has an inner surface covered with a white material.

19. A portable light weight bed lamp comprising:

an adjustable head band adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, a light diffusing lens mounted in said housing between said bulb and an opening leading out of said housing, and a combination heat shield and light reflector mounted in said housing on one side of said bulb, said bulb being disposed between said combination and said diffusing lens, said combination being curved in a direction toward said bulb and being adapted to both dissipate heat emitted from said bulb and reflect light emitted from said bulb through said lens and out of said opening, said housing being adjustably connected to said headband by a ball and socket joint, said headband having a hollow interior, said bulb having an upper end and a bottom and being electronically connected to a power supply by a first electronic conduit connected to a C-shaped resilient clip surrounding the upper end of said bulb and by a second electric conduit coupled to a spring engaged by the bottom of said bulb, both of said conduits extending first through a throughbore in said ball and socket joint, then through the interior of said headband and out of an opening therein to said power supply.

20. A portable light weight bed lamp comprising:

an adjustable headband adapted to be worn about a head of a user;

a light housing mounted on said headband, said light housing being adjustable with respect to said headband so that a light beam emitting from a bulb disposed in said light housing out of an opening leading from said housing can be adjusted to fall on a particular location in front of the user; and said light housing including a high intensity light bulb mounted therein coupled to a power source for selectively lighting said bulb, an opening leading out of said housing disposed away from said bulb, and a combination heat shield and light reflector mounted in said housing on one side of said bulb, said bulb being disposed between said combination and said opening, said combination and said bulb forming uniform light diffusing means adapted to both dissipate heat emitted from said bulb and reflect light emitted from said bulb into a light beam uniform in intensity over the entire area thereof through and out of said opening whereby said light illuminates a relatively large area with a uniform light beam.

* * * * *